US009422661B2

(12) United States Patent
Mantle et al.

(10) Patent No.: US 9,422,661 B2
(45) Date of Patent: Aug. 23, 2016

(54) PUMP ASSEMBLY FOR A WASHING MACHINE APPLIANCE

(75) Inventors: Paul Douglas Mantle, Crestwood, KY (US); Lawrence Thomas, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1125 days.

(21) Appl. No.: 13/452,134

(22) Filed: Apr. 20, 2012

(65) Prior Publication Data

US 2013/0276484 A1 Oct. 24, 2013

(51) Int. Cl.

| | |
|---|---|
| ***D06F 39/10*** | (2006.01) |
| ***E03B 7/07*** | (2006.01) |
| ***D06F 37/02*** | (2006.01) |
| ***D06F 39/08*** | (2006.01) |

(52) U.S. Cl.

CPC ..... *D06F 39/10* (2013.01); *D06F 39/083* (2013.01); *D06F 39/088* (2013.01); *Y10T 137/794* (2015.04)

(58) Field of Classification Search

CPC ..... D06F 39/10; D06F 39/088; D06F 39/083; Y10T 137/794

See application file for complete search history.

(56) References Cited

U.S. PATENT DOCUMENTS

| | | | | |
|---|---|---|---|---|
| 3,977,219 | A * | 8/1976 | Bochan | D06F 9/10 210/411 |
| 4,833,900 | A * | 5/1989 | Babuin | D06F 9/10 134/111 |
| 7,406,843 | B2 | 8/2008 | Thies et al. | |
| 2004/0129034 | A1 * | 7/2004 | Zanello | D06F 9/10 68/18 F |
| 2011/0100071 | A1 * | 5/2011 | Mazzon | D06F 9/10 68/208 |

* cited by examiner

*Primary Examiner* — Michael Barr
*Assistant Examiner* — Benjamin L Osterhout
(74) *Attorney, Agent, or Firm* — Dority & Manning, P.A.

(57) ABSTRACT

A pump assembly for a washing machine appliance is provided. The pump assembly includes a casing that receives a filter. The filter includes a labyrinth filter portion and a mesh filter portion. A drain pump is in fluid communication with the labyrinth filter portion, and a recirculation pump is in fluid communication with the mesh filter portion. Related washing machine appliances are also provided.

16 Claims, 5 Drawing Sheets

PUMP ASSEMBLY FOR A WASHING MACHINE APPLIANCE

FIELD OF THE INVENTION

The present subject matter relates generally to pump assemblies for washing machine appliances and, in particular, to pump assemblies with a filter.

BACKGROUND OF THE INVENTION

Generally, washing machine appliances include a cabinet with a wash tub mounted therein. A wash basket is rotatably mounted within the wash tub and receives articles for washing. During operation of the appliance, washing fluid (e.g., water and/or detergent) is used to clean articles disposed within the wash basket. For example, after a user makes selections regarding wash and rinse cycles, the washing machine operates one or more valves to fill the wash tub with a certain amount of water. Additives such as detergent and fabric softeners may also be added manually or automatically to the water to form the washing fluid.

The wash tub may be drained and filled several times depending upon the wash and rinse cycles selected or programmed for the cleaning process. In addition, washing fluid may be circulated through the wash tub during wash or rinse cycles to assist in cleaning articles disposed in the wash basket. The washing machine can include a pump assembly for draining and/or recirculating fluid in the appliance. For example, the pump assembly can include a pump for draining the washing fluid from the wash tub, e.g., after completion of wash or rinse cycles.

The pump assembly is generally mounted below the wash tub within the appliance's cabinet. Presently, many components of the washing machine are mounted and/or stored below the wash tub, e.g., a bulk fluid dispenser. Accordingly, space within the cabinet below the wash tub is often at a premium. Thus, a pump assembly with features for conserving valuable space within the appliance's cabinet would be useful.

The pump assembly also generally includes a filter. The filter is mounted within the pump assembly and screens out e.g., buttons, lint, hair, dirt, and/or other particles that could potentially damage the pump assembly. However, a filter can require maintenance, e.g., cleaning out the filter. Such maintenance can be time consuming and inconvenient. Thus, a pump assembly with an improved filter and features for increasing the time period between cleanings of the filter would be appreciated.

During filter maintenance, a user must generally access the filter. In certain washing machine appliance, the pump assembly's filter can be difficult and/or inconvenient to access. Thus, during maintenance or service of pump assembly, valuable time and/or energy can be wasted accessing the pump assembly's filter. Accordingly, a pump assembly with features for facilitating access to a filter of the pump assembly would be useful.

In particular, certain filters are secured within a pump assembly with a cap having screw threads that require multiple complete rotations to secure the filter within the pump assembly. Thus, during maintenance, a user must complete multiple rotations of the cap to secure the filter. In addition, the cap can assist in compressing a seal on the filter to provide a water-tight barrier that prevents fluid from escaping the pump assembly. For example, certain filters include a face seal that must be compressed against a casing of the pump assembly to properly set. However, during maintenance, it can be difficult to ascertain if the cap has been sufficiently rotated to compress the seal against the casing. If the seal is not properly set, the pump assembly can leak during operation of the appliance. Thus, a pump assembly with features for conveniently securing a filter within the pump assembly without multiple complete rotations of a cap would be appreciated. Also, a pump assembly with filter having a seal that does not require multiple complete rotations of a cap to compress the seal would be useful.

BRIEF DESCRIPTION OF THE INVENTION

Aspects and advantages of the invention will be set forth in part in the following description, or may be obvious from the description, or may be learned through practice of the invention.

In a first embodiment, a washing machine appliance is provided. The washing machine appliance includes a cabinet. A wash tub is received in the cabinet and configured for containing a fluid used in a washing process. A wash basket is mounted in the wash tub. The wash basket is configured for the receipt of articles during the washing process and for rotation about an axis. A drain is configured for directing fluid out of the cabinet. The washing machine appliance also includes a pump assembly. The pump assembly includes a casing that defines a chamber. The chamber extends longitudinally between a first end and a second end. The casing defines an inlet positioned adjacent the first end of the chamber. The inlet is configured for receipt of fluid from the wash tub. The casing also defines an opening positioned adjacent the second end of the chamber. The opening is configured for permitting selective access the chamber of the casing. A filter is received within the chamber of the casing. The filter extends longitudinally between a labyrinth filter portion and a mesh filter portion. A drain pump is in fluid communication with the chamber of the casing and the drain such that the drain pump selectively urges fluid disposed within the chamber to the drain. The drain pump positioned adjacent the labyrinth filter portion of the filter. A recirculation pump is in fluid communication with the chamber of the casing and the wash tub such that the recirculation pump selectively urges fluid disposed within the chamber to the wash tub. The recirculation pump is positioned adjacent the mesh filter portion of the filter.

In a second embodiment a pump assembly for a washing machine appliance is provided. The appliance has a cabinet that defines a compartment for receipt of articles for washing and a drain for directing fluid out of the appliance. The pump assembly includes a casing that defines a chamber. The chamber extends longitudinally between a first end and a second end. The casing defines an inlet positioned adjacent the first end of the chamber. The inlet is configured for receipt of fluid from the compartment of the cabinet. The casing also defines an opening positioned adjacent the second end of the chamber. The opening is configured for permitting selective access the chamber of the casing. A filter is received within the chamber of the casing. The filter extends longitudinally between a labyrinth filter portion and a mesh filter portion. A drain pump is in fluid communication with the chamber of the casing. The drain pump is configured for selectively urging fluid disposed within the chamber to the drain of the appliance. The drain pump receives fluid from the labyrinth filter portion of the filter. A recirculation pump is in fluid communication with the chamber of the casing. The recirculation pump is configured for selectively urging fluid disposed within the chamber to the compartment of the cabinet. The recirculation pump receives fluid from the mesh filter portion of the filter.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
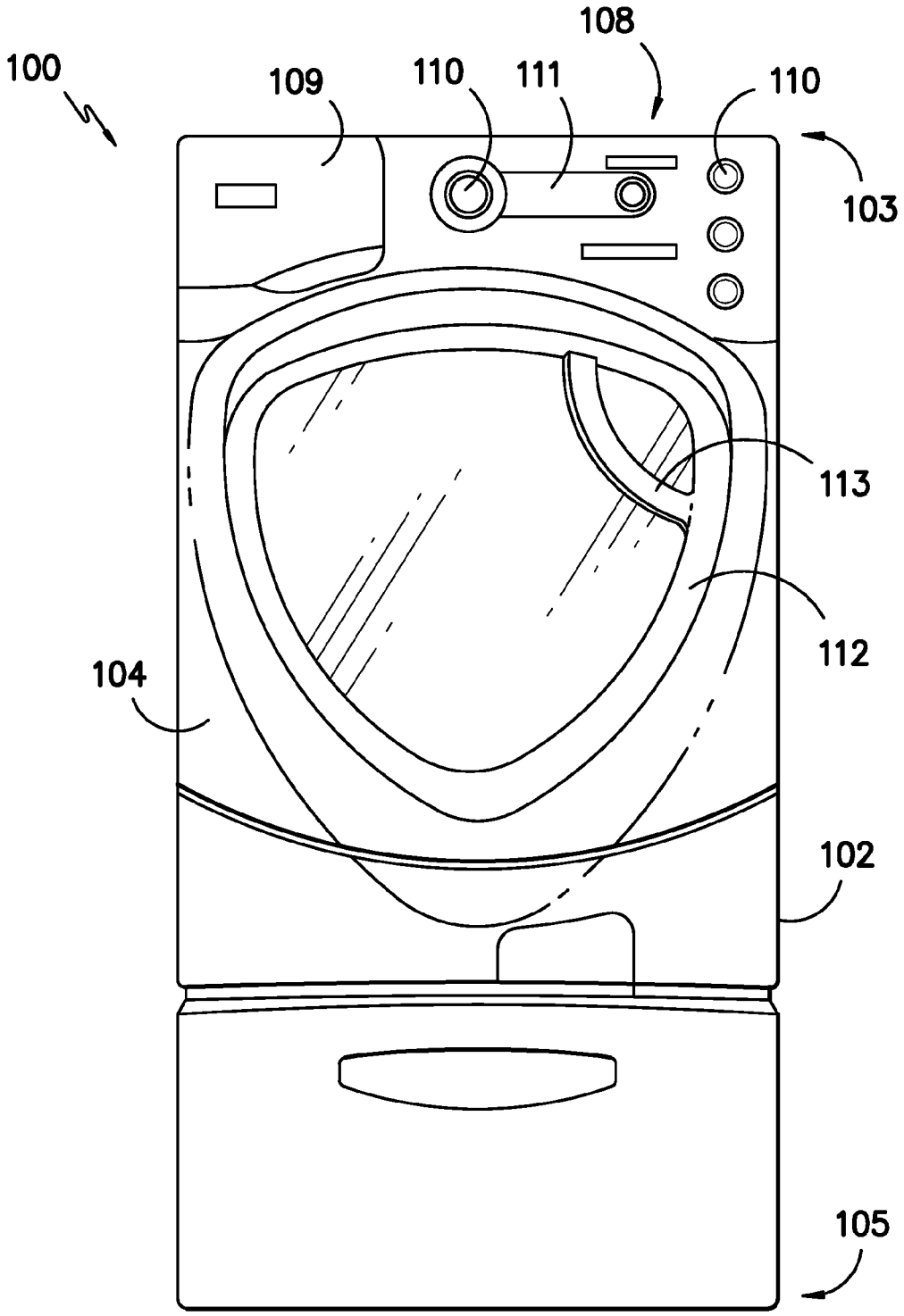
FIG. 1 provides a front view of an exemplary washing machine appliance according to an embodiment of the present subject matter.

A pump assembly for a washing machine appliance is provided. The pump assembly includes a casing that receives a filter. The filter includes a labyrinth filter portion and a mesh filter portion. A drain pump is in fluid communication with the labyrinth filter portion, and a recirculation pump is in fluid communication with the mesh filter portion. Related washing machine appliances are also provided. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
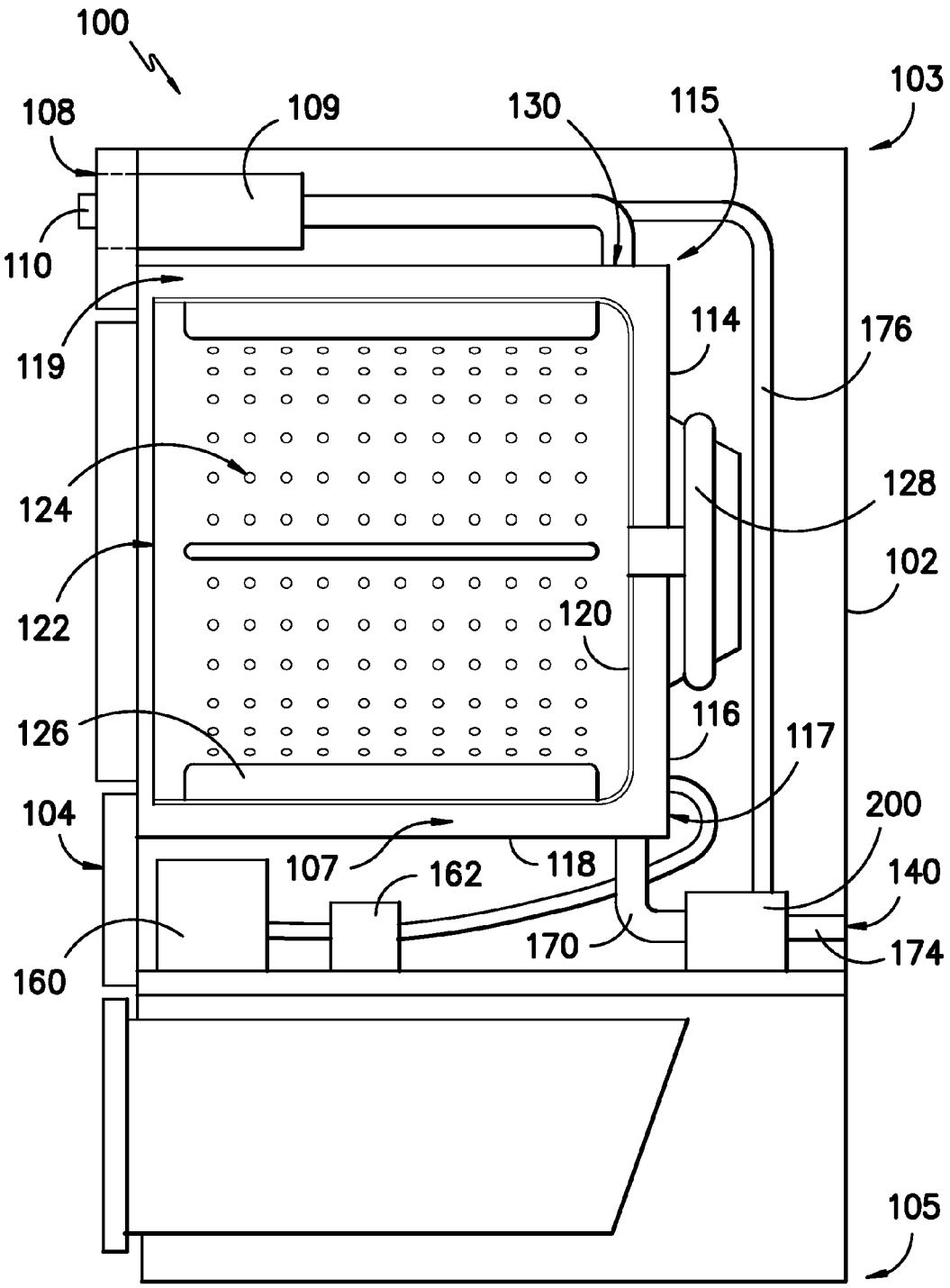
FIG. 2 illustrates a cross-sectional view of the washing machine appliance of FIG. 1 and, in particular, an exemplary pump assembly is shown.

FIG. 1 is a front view of an exemplary horizontal axis washing machine appliance 100 having a cabinet 102. FIG. 2 is a side cross-sectional view of washing machine appliance 100. Cabinet 102 extends between a top 103 and a bottom 105. Cabinet also includes a front panel 104. A door 112 is mounted to front panel 104 and is rotatable about a hinge (not shown) between an open position (not shown) facilitating access to a wash basket 120 (FIG. 2) located within cabinet 102, and a closed position (FIG. 1) prohibiting access to wash basket 120. A user may pull on a handle 113 in order to adjust door 112 between the open position and the closed position.

A control panel 108 including a plurality of input selectors 110 is coupled to front panel 104. Control panel 108 and input selectors 110 collectively form a user interface input for operator selection of machine cycles and features. For example, in one embodiment, a display 111 indicates selected features, a countdown timer, and/or other items of interest to machine users.

Referring now to FIG. 2, a wash tub 114 defines a wash compartment 119 configured for receipt of a washing fluid. Thus, wash tub 114 is configured for containing washing fluid. Washing fluid disposed in wash tub 114 may include, e.g., water, fabric softener, bleach, and/or detergent. Wash tub 114 includes a back wall 116 and a sidewall 118 and also extends between a top 115 and a bottom 117.

Wash basket 120 is rotatably mounted within wash tub 114 in a spaced apart relationship from tub sidewall 118 and the tub back wall 116. Basket 120 defines an opening 122 for receiving articles for washing. Basket 120 also defines a plurality of perforations 124 to facilitate fluid communication between an interior of basket 120 and wash tub 114. A sump 107 is defined by wash tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into wash tub 114. Spout 130 may be in fluid communication with a water supply (not shown) in order to direct fluid (e.g., clean water) into wash tub 114. Spout 130 may also be in fluid communication with the sump 107. For example, a pump assembly 200 may direct washing fluid disposed in sump 107 to spout 130 in order to circulate washing fluid in wash tub 114. In alternative exemplary embodiments, a spray nozzle (not shown) can be mounted adjacent door 112, e.g., within a gasket (not shown) of door 112. The spray nozzle may operate in a similar manner to spout 130 in order to direct fluid into wash tub 114. Spout 130 and/or the spray nozzle may be mounted at any suitable location within washing machine appliance 100 in order to direct fluid into wash tub 114.

Pump assembly 200 (shown schematically in FIG. 2) is located beneath tub 114 for draining tub 114 of fluid. Pump assembly 200 is in fluid communication with sump 107 of wash tub 114 via a conduit 170. Thus, conduit 170 directs fluid from wash tub 114 to pump assembly 200. Pump assembly 200 is also in fluid communication with a drain 140 via piping 174. Pump assembly 200 can urge fluid disposed in sump 107 to drain 140 during operation of appliance 100 in order to remove fluid from wash tub 114. Fluid received by drain 140 from pump assembly 200 is directed out of appliance 100, e.g., to a sewer or septic system.

In addition, pump assembly 200 is configured for recirculating washing fluid within wash tub 114. Thus, pump assembly 200 is configured for urging fluid from sump 107, e.g., to spout 130 or another portion of wash tub 114. For example, pump assembly 200 may urge washing fluid in sump 107 to spout 130 and the spray nozzle (not shown) via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of washing machine appliance 100 as described below. Ribs 126 extend from basket 120 into wash compartment 119. Ribs 126 assist agitation of articles disposed within wash compartment 119 during operation of washing machine appliance 100. For example, ribs 126 may lift articles disposed in basket 120 during rotation of basket 120.

A drawer 109 is slidably mounted within front panel 104. Drawer 109 receives a fluid additive (e.g., detergent, fabric softener, bleach, or any other suitable liquid) and directs the fluid additive to wash compartment 119 during operation of appliance 100. Additionally, a reservoir 160 is disposed within cabinet 102. Reservoir 160 is also configured for receipt of fluid additive for use during operation of washing machine appliance 100 (shown in FIG. 1). Reservoir 160 is sized such that a volume of fluid additive sufficient for a plurality or multitude of wash cycles of appliance 100 may fill reservoir 160. Thus, for example, a user can fill reservoir 160 with fluid additive and operate appliance 100 for a plurality of wash cycles without refilling reservoir 160 with fluid additive. A reservoir pump 162 is configured for selective delivery of the fluid additive from reservoir 160 to wash tub 114.

Operation of washing machine appliance 100 is controlled by a controller or processing device (not shown), that is operatively coupled to control panel 108 (FIG. 1) for user manipulation to select washing machine cycles and features. In response to user manipulation of control panel 108, the controller operates the various components of washing machine appliance 100 to execute selected machine cycles and features.

In an illustrative embodiment, laundry items are loaded into wash basket 120, and washing operation is initiated through operator manipulation of input selectors 110. Wash tub 114 is filled with water and detergent to form a wash fluid. One or more valves (not shown) can be controlled by washing machine appliance 100 to provide for filling wash tub 114 to the appropriate level for the amount of articles being washed. Once wash tub 114 is properly filled with fluid, the contents of wash basket 120 are agitated with ribs 126 for cleansing of laundry items in basket 120.

After the agitation phase of the wash cycle is completed, wash tub 114 is drained. Laundry articles can then be rinsed by again adding fluid to wash tub 114, depending on the particulars of the cleaning cycle selected by a user, ribs 126 may again provide agitation within wash compartment 119. One or more spin cycles may also be used. In particular, a spin cycle may be applied after the wash cycle and/or after the rinse cycle in order to wring wash fluid from the articles being washed. During a spin cycle, basket 120 is rotated at relatively high speeds.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. In addition, the teachings disclosed herein may be used with other appliances as well, e.g., a dishwasher appliance.

Figure 3:
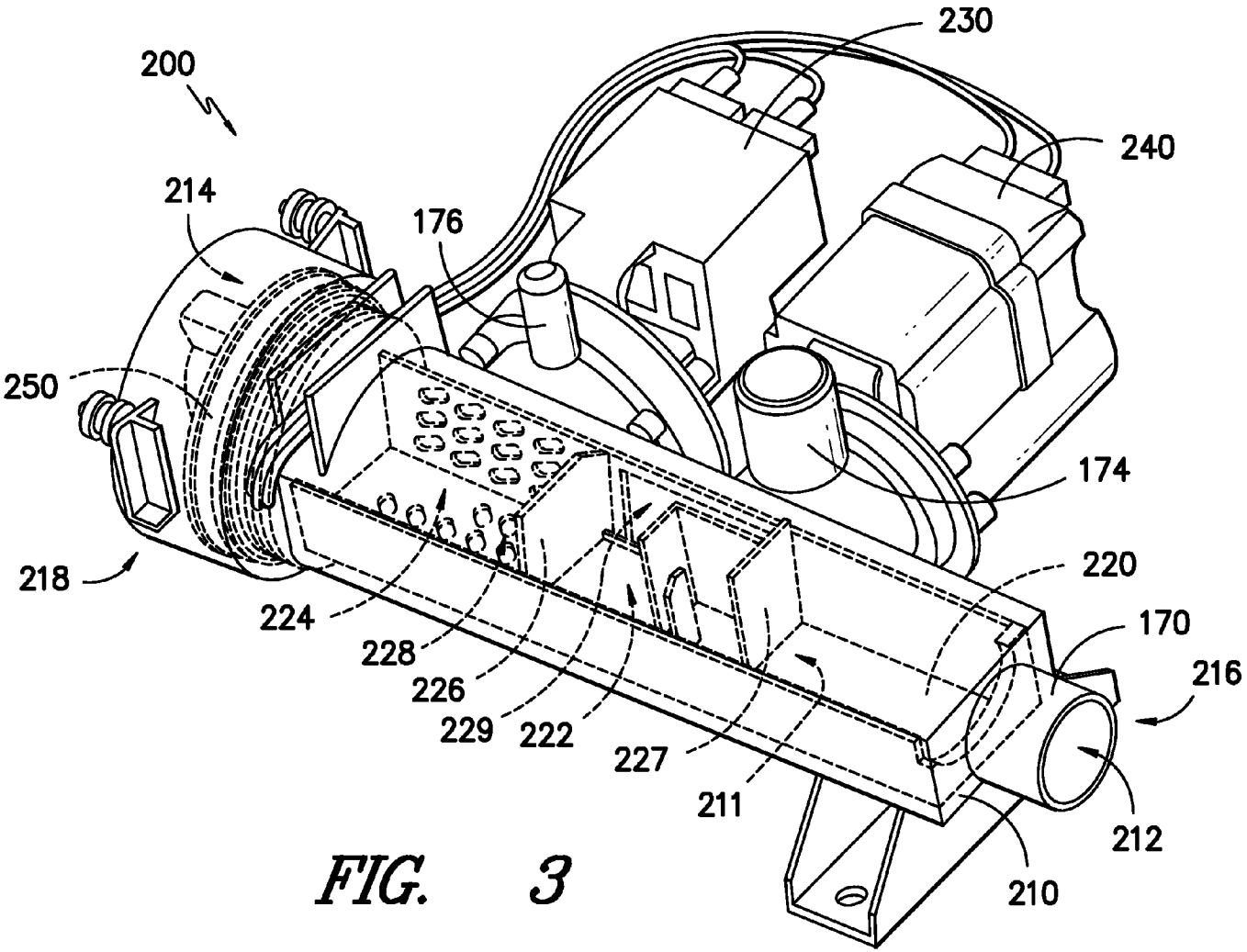
FIG. 3 provides a perspective view of an exemplary pump assembly with an exemplary filter received within a casing of the pump assembly.

FIG. 3 illustrates pump assembly 200. Pump assembly 200 includes a housing or casing 210 that defines a chamber 211. Casing 210 extends between a first end 216 and a second end 218. An inlet 212 is defined by casing 210 adjacent first end 216 of casing 210, and an opening 214 is defined by casing 210 adjacent second end 218 of casing 210. Inlet 212 is configured for receiving fluid from wash tub 114 (FIG. 2) and, thus, is in fluid communication with wash tub 114 via piping 170 (FIG. 2). For example, during operation of appliance 100, washing fluid from wash tub 114 may enter inlet 212 in order to fill chamber 211 of casing 210 with washing fluid.

Pump assembly 200 also includes a dual-stage filter 220 slidably received within chamber 211 of casing 210. For example, filter 220 may slide into casing 210 through opening 214. Thus, opening 214 permits access to chamber 211, e.g., in order to remove and/or insert filter 220 into chamber 211. Filter 220 includes two stages, a labyrinth filter portion 222 and a mesh filter portion 224. Both labyrinth and mesh filter portions 222, 224 of filter 220 are configured for removing particles from a flow of fluid through chamber 211 of casing 210. Labyrinth filter portion 222 is configured for removing relatively larger particles from fluid. For example, labyrinth filter portion 222 may be configured for removing foreign items such as buttons, pins, and/or coins. Conversely, mesh filter portion 224 is configured for removing relatively smaller particles from fluid. For example, mesh filter portion 224 may be configured for removing items such as hair, lint, and/or dirt.

A drain pump 240 is mounted to casing 210 adjacent labyrinth filter portion 222 of filter 220. Drain pump 240 urges fluid in chamber 211 to drain 140 (FIG. 2) through piping 174 (FIG. 2). Thus, drain pump 240 is in fluid communication with chamber 211 and drain 140 and is configured for receipt of fluid from chamber 211. For example, fluid from chamber 211 flows through a drain hole 229 defined by filter 220 into drain pump 240. Fluid from chamber 211 passes through labyrinth portion 222 of filter 220 prior to entering drain pump 240. Thus, large foreign objects (e.g., buttons, coins, and/or pins) disposed in the fluid are prevented from entering drain pump 240 and potentially damaging drain pump 240, e.g., damaging an impeller (not shown) of drain pump 240. However, labyrinth filter portion 222 permits smaller foreign objects (e.g., hair, lint, and/or dirt) to pass into drain pump 240 and exit appliance 100 via drain 140. Thus, such smaller foreign objects are removed from appliance 100.

A recirculation pump 230 is mounted to casing 210 adjacent mesh filter portion 224 of filter 220. Recirculation pump 230 urges fluid in chamber 211 to spout 130 (FIG. 2) through hose 176 (FIG. 2). Thus, recirculation pump 230 is in fluid communication with chamber 211 and spout 130 and is configured for receipt of fluid from chamber 211. For example, fluid from chamber 211 flows through a plurality of holes 228 defined by filter 220 into recirculation pump 230. Fluid from chamber 211 passes through labyrinth filter portion 222 and mesh filter portion 224 of filter 220 prior to entering recirculation pump 230. Thus, both large and small foreign objects disposed in the fluid are prevented from entering recirculation pump 230 and potentially damaging the recirculation pump 230, e.g., damaging an impeller (not shown) of the recirculation pump 240. Also, mesh filter portion 240 assists in preventing smaller foreign objects from clogging spout 130. Similarly, in alternative exemplary embodiments, mesh filter portion 240 may prevent clogging of the spray nozzle (not shown) located at end of hose 176 (shown in FIG. 2).

In FIG. 3, recirculation and drain pumps 230, 240 are positioned on casing 210 such that recirculation and drain pumps 230, 240 are substantially side-by-side. However, it should be understood that in alternative embodiments recirculation and drain pumps 230, 240 may be mounted to casing 210 in any suitable fashion, e.g., head-to-head or recirculation pump 230 may be mounted on top of drain pump 240 or vice versa. Alternatively, recirculation and drain pumps 230, 240 may be spaced apart from casing 210 and in fluid communication with chamber 211 using suitable conduits, pipes, hoses, ducts, etc.

A cap 250 is disposed adjacent opening 214 of casing 210. Cap 250 is complementary in shape to opening 214 and is received within opening 214. Cap 250 assists in securing filter 220 within chamber 211 of casing 210. Cap 250 is discussed in greater detail below.

Figure 4:
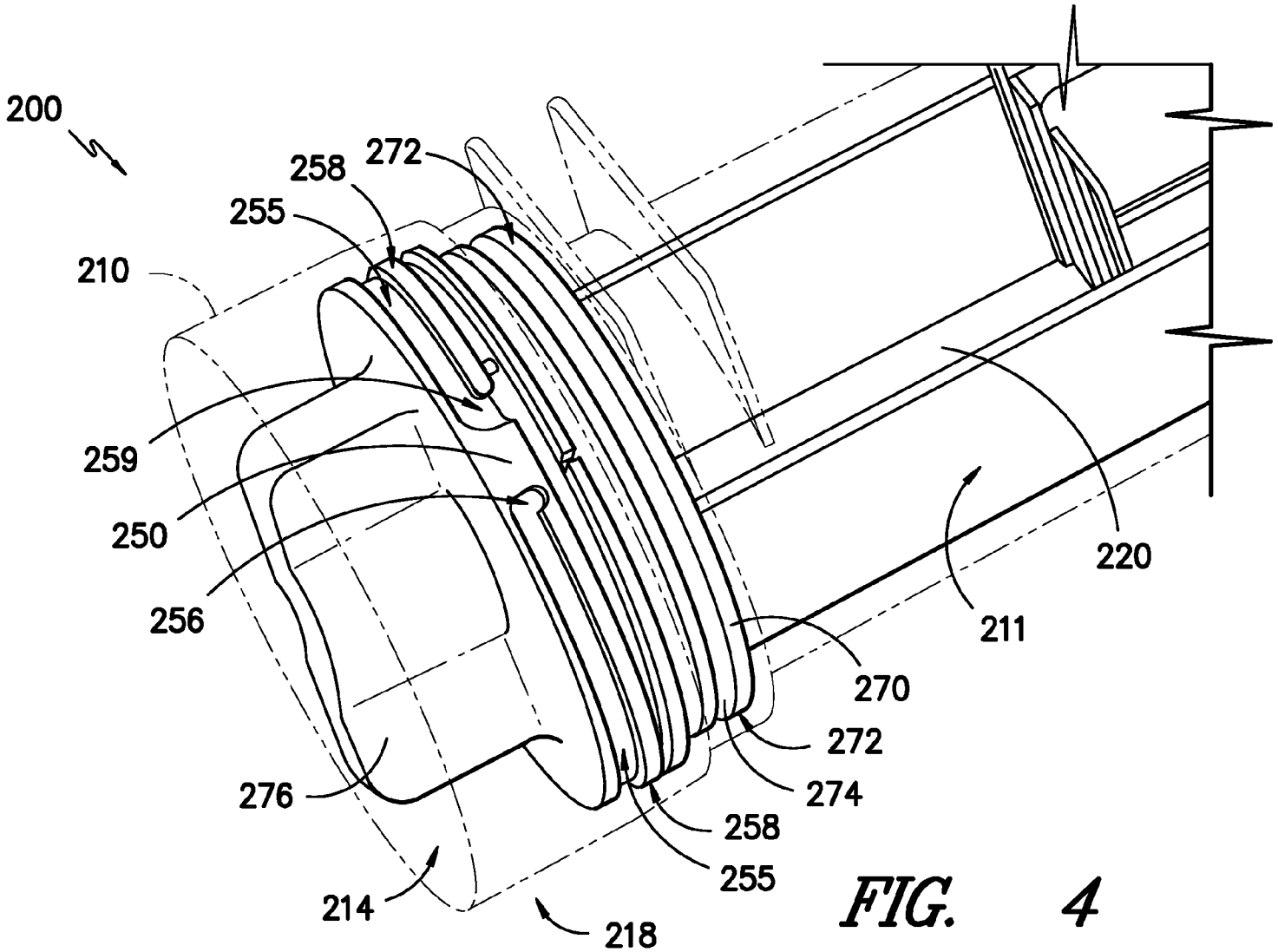
FIG. 4 illustrates a perspective view of an exemplary cap used to secure the filter within the casing shown in FIG. 3.
Figure 5:
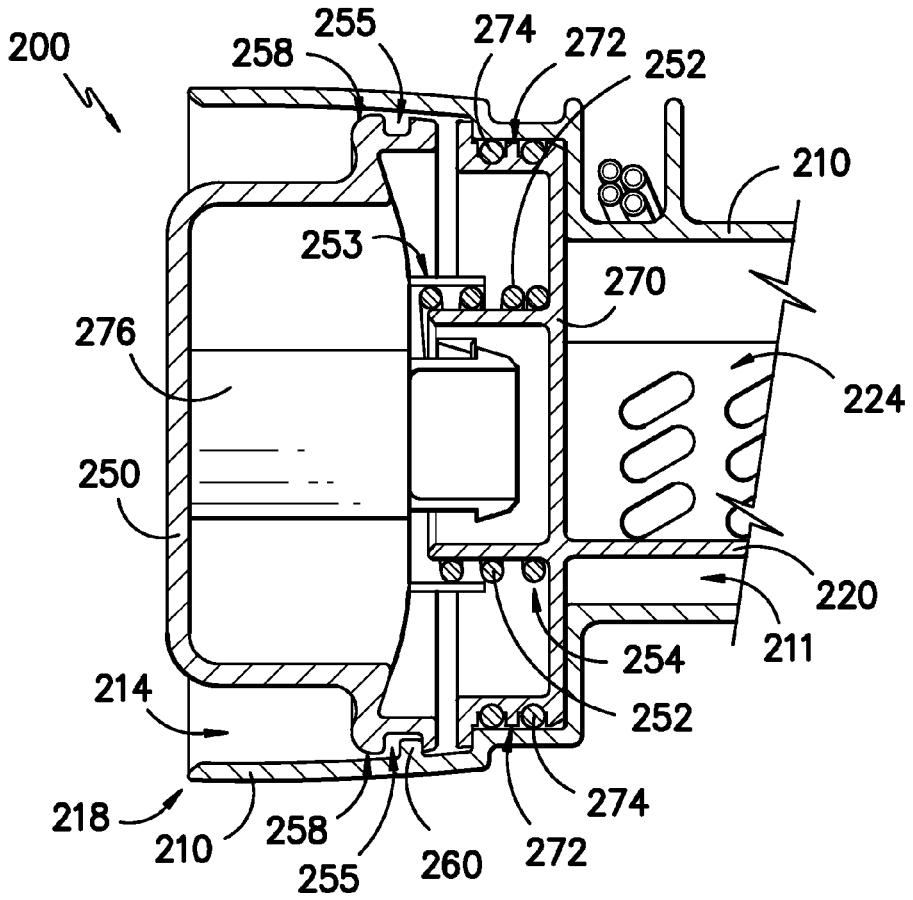
FIG. 5 illustrates a cross-sectional view of the cap shown in FIG. 4.

FIGS. 4 and 5 illustrate cap 250 securing filter 220 within chamber 211 of casing 210. Cap 250 includes a circumferential surface 258 that is complementary in shape to opening 214 such that cap 250 may be received within opening 250 with circumferential surface 258 positioned adjacent casing 210. Circumferential surface 258 defines slots 255 configured for receipt of tabs 260 (FIG. 5) defined by casing 210. Tabs 260 are positioned adjacent second end 218 of casing within opening 214. Tabs 260 extend from casing 210 into opening 214. Slots 255 receive tabs 260 and direct tabs to notches 256 defined by cap 250 on circumferential surface 258. For example, a user may align a particular tab 260 with an entrance 259 of a particular slot 255 and guide the tab 260 into the slot 255. The user may then rotate the cap 250 using a handle 276 of the cap 250. As the cap 250 rotates, the tab 260 slides within the slot 255 until the tab 260 reaches the notch 256.

Tabs 260 may be uniformly disposed on casing 210 about opening 214 such that cap 250 has a multiple insertion configurations. As an example, with three tabs 260 spaced one hundred and twenty degrees apart about opening 214, a user may align any one of slots 255 with any one of tabs 260 to secure cap 250 to casing 210. Conversely, tabs 260 may be non-uniformly disposed on casing 210 about opening 214 such that cap 250 has a single, unique insertion configuration. As an example, a first tab (not shown) may be spaced apart from a second tab (not shown) by about one hundred and ten degrees, the second tab may be spaced apart from a third tab (not shown) by about one hundred and twenty degrees, and the third tab may be spaced apart from the first tab by about one hundred and thirty degrees. In such a configuration, the user must align a particular one of the slots 255 with each of the first, second, and third tabs respectively to secure cap 250 to casing 210. Thus, the cap 250 has only one, unique insertion configuration. Cap 250 can also include ID markings that communicate when the user has fully rotated cap 250.

As shown in FIG. 5, cap 250 includes a spring 252 that extends between a first end 253 and a second end 254. First end 253 of spring 252 is disposed adjacent cap 250, and second end 254 of spring 252 is disposed adjacent filter 220. Spring 252 urges filter 220 and cap 250 apart in order to assist in securing filter 220 within chamber 211 of casing 210. For example, spring 252 urges the tab 260 into notch 256 in order to secure cap 250 in opening 214 of casing 210 by preventing cap 250 from rotating. With cap 250 mounted to casing 210, spring 252 urges filter 220 into chamber 211 and, thus, prevents filter 220 from sliding out of chamber 211.

However, cap 250 selectively secures filter 220 within chamber 211 of casing 210. Thus, cap 250 also permits a user to selectively remove filter 220 from chamber 211. For example, with cap securing filter 220 within chamber 211 as shown in FIGS. 4 and 5, a user may press cap 250 inward—i.e., towards casing 210, to remove tab 260 from notch 256. The user may then rotate cap 250 until tab 260 exits slot 255 at entrance 259. The user can then remove cap 250 from opening 214 and slide filter 220 out of chamber 211. Spring 252 can assist a user in removing cap 250 from casing 210. For example, force applied by spring 252 combined with force applied by the user can urge cap 250 axially out of chamber 211 by pushing tabs 260 out of slots 255 at entrance 259.

As discussed above, cap 250 selectively secures filter 220 within chamber 211. To remove the tab 260 from slot 255, the user may have to rotate the cap 250 about ninety degrees, sixty degrees, or any other suitable amount. However, cap 250 is configured such that cap 250 does not need to complete more than a single compete rotation (i.e., three hundred and sixty degrees) in order to remove cap 250 from opening 214. In alternative embodiments, any suitable mechanism may be used to secure filter 220 within chamber 211, e.g., a threaded cap or plug.

As may be seen in FIG. 5, second end 254 of spring 252 is mounted to a plug 270 of filter 220. Plug 270 is complementary in shape to opening 214 and is positioned adjacent second end 218 of casing 210 at opening 214 in order to bung chamber 211. Plug 270 has an outer circumferential surface 272 that is positioned adjacent casing 210. A seal 274 is disposed on outer circumferential surface 272 to assist in sealing chamber 211 and preventing fluid from leaking out of chamber 211, e.g., during operation of appliance 100. Thus, seal 274 cooperates with casing 210 to inhibit fluid from exiting chamber 211 through opening 214. Seal 274 compresses against casing 210 when filter 220 slides into chamber 211. Thus, filter 220 and/or cap 250 need not be rotated to compress seal 274 against casing 210. Seal 274 may include, e.g., an o-ring. In alternative embodiments, any suitable mechanism may be used to seal chamber 211, e.g., a face seal.

Figure 6:
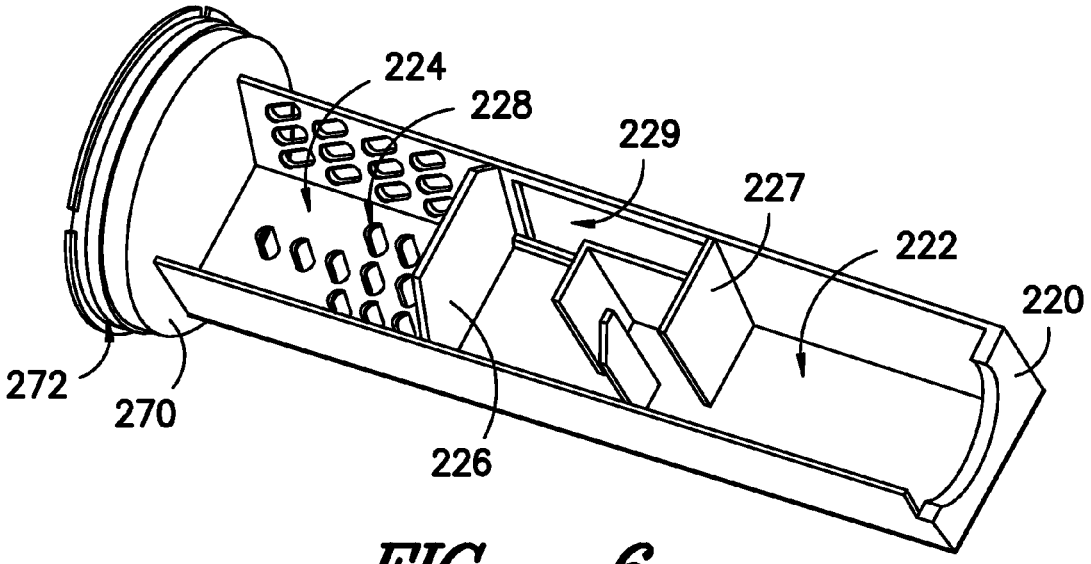
FIG. 6 provides a perspective view of the filter shown in FIG. 3.

FIG. 6 illustrates filter 220 disposed outside of chamber 211 (FIG. 3). Filter 220 may be removed from chamber 211, e.g., to clean filter 220 or service pump assembly 200. Labyrinth filter portion 222 of filter 220 defines drain hole 229 for permitting fluid to flow through labyrinth filter portion 222 into drain pump 240 (FIG. 3). Labyrinth filter portion 222 of filter 220 includes a plurality of projections 227 that extend from filter 220. Plurality of projections 227 are configured for causing a flow of fluid through labyrinth filter portion 222 to change direction. Plurality of projections 227 are spaced and sized for impeding and/or catching relatively large foreign objects (e.g., buttons, coins, and/or pins). Thus, such large foreign objects may be prevented from entering, e.g., drain or recirculation pumps 230, 240 (FIG. 3) by labyrinth filter portion 222.

Mesh filter portion 224 of filter 220 includes a plurality of holes 228 that are defined by filter 220 and permit a flow of fluid through mesh filter portion 224 into recirculation pump 230 (FIG. 3). Plurality of holes 228 are spaced and sized for impeding and/or catching relatively small foreign objects (e.g., hair, lint, and/or dirt). Thus, such small foreign objects may be prevented from entering, e.g., recirculation pumps 230 (FIG. 3) by mesh filter portion 224.

A partition 226 separates mesh filter portion 224 and labyrinth filter portion 222. Thus, partition 226 is disposed between mesh filter portion 224 and labyrinth filter portion 222. However, partition 226 does not prevent a flow of fluid between mesh filter portion 224 and labyrinth filter portion 222. Thus, fluid can flow from labyrinth filter portion 222 into mesh filter portion 224. Partition 226 is configured for prohibiting relatively large foreign objects from entering mesh filter portion 224 in order to prevent such objects from damaging components of pump assembly 200 (e.g., recirculation pump 230) (shown in FIG. 3).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub received in said cabinet and configured for containing a fluid used in a washing process;

a wash basket mounted in said wash tub, said wash basket configured for the receipt of articles during the washing process and for rotation about an axis;

a drain configured for directing fluid out of said cabinet;

a pump assembly, said pump assembly comprising:

a casing that defines a chamber, said chamber extending longitudinally between a first end and a second end, said casing defining an inlet positioned adjacent the first end of said chamber, the inlet configured for receipt of fluid from said wash tub, said casing also defining an opening positioned adjacent the second end of said chamber, the opening configured for permitting selective access to the chamber of said casing;

a filter received within the chamber of said casing, said filter extending longitudinally between a labyrinth filter portion and a mesh filter portion;

a drain pump in fluid communication with the chamber of said casing and said drain such that said drain pump selectively urges fluid disposed within the chamber to said drain, said drain pump positioned adjacent the labyrinth filter portion of said filter;

a recirculation pump in fluid communication with the chamber of said casing and said wash tub such that said recirculation pump selectively urges fluid disposed within the chamber to said wash tub, said recirculation pump positioned adjacent the mesh filter portion of said filter;

a cap positioned adjacent the opening of said casing, the cap configured for selectively securing said filter within the chamber defined by said casing, said cap being substantially complementary in shape to the opening of said casing, said cap having:

a circumferential surface that defines a slot or directing of a tab of said casing that extends from said casing and is positioned adjacent the opening of said casing, the circumferential surface also defining a notch within the slot for receiving the tab; and a spring that extends between a first end and second end, the first end of said spring disposed adjacent said filter, the second end of said spring disposed adjacent said cap, the spring urging said cap and said filter apart such that the tab of said casing is received by the notch of said cap in order to secure said cap to said casing and said filter is urged into the chamber of said casing.

2. The washing machine appliance of claim 1, wherein said drain pump and said recirculation pump are mounted to said casing such the said drain pump and said recirculation pump are substantially side by side.

3. The washing machine appliance of claim 1, wherein said the labyrinth filter portion of said filter is positioned adjacent the first end of said casing and the mesh filter portion of said filter is positioned adjacent the second end of said casing.

4. The washing machine appliance of claim 1, wherein said filter is slidingly received within the chamber of said casing such that said filter may be selectively removed from the chamber through the opening of said casing.

5. The washing machine appliance of claim 1, wherein the labyrinth filter portion of said filter includes a plurality of projections that extend from said filter into the chamber of said casing such that the plurality of projections cause a flow of fluid through the chamber to change direction.

6. The washing machine appliance of claim 1, wherein the mesh filter portion of said filter includes a plurality of holes defined by said filter, the plurality of holes permitting a flow of fluid through the chamber to enter the recirculation pump from the chamber of said casing.

7. The washing machine appliance of claim 1, wherein said filter includes a partition disposed between the labyrinth filter portion of said filter and the mesh filter portion of said filter, the partition permitting a flow of fluid between the labyrinth filter portion and the mesh filter portion.

8. The washing machine appliance of claim 1, wherein said filter includes a plug disposed adjacent the opening of said cavity, the plug being complementary in shape to the opening of said casing, the plug including a seal disposed on a circumferential surface of said plug.

9. A pump assembly for an appliance, the appliance having a cabinet that defines a compartment for receipt of articles for washing and a drain for directing fluid out of the appliance, said pump assembly comprising:

a casing that defines a chamber, the chamber extending longitudinally between a first end and a second end, the casing defining an inlet positioned adjacent the first end of the chamber, the inlet configured for receipt of fluid from the compartment of the cabinet, the casing also defining an opening positioned adjacent the second end of the chamber, the opening configured for permitting selective access the chamber of said casing;

a filter received within the chamber of said casing, the filter extending longitudinally between a labyrinth filter portion and a mesh filter portion;

a drain pump in fluid communication with the chamber of said casing, said drain pump configured for selectively urging fluid disposed within the chamber to the drain of the appliance, said drain pump receiving fluid from the labyrinth filter portion of said filter;

a recirculation pump in fluid communication with the chamber of said casing, said recirculation pump configured for selectively urging fluid disposed within the chamber to the compartment of the cabinet, said recirculation pump receiving fluid from the mesh filter portion of said filter;

a cap positioned adjacent the opening of said casing, the cap configured for selectively securing said filter within the chamber defined by said casing, said cap being substantially complementary in shape to the opening of said casing, said cap having:

a circumferential surface that defines a slot for directing of a tab of said casing that extends from said casing and is positioned adjacent the opening of said casing, the circumferential surface also defining a notch within the slot for receiving the tab; and a spring that extends between a first end and second end, the first end of said spring disposed adjacent said filter, the second end of said spring disposed adjacent said cap, the spring urging said cap and said filter apart such that the tab of said casing is received by the notch of said cap in order to secure said cap to said casing and said filter is urged into the chamber of said casing.

10. The pump assembly of claim 9, wherein said drain pump and said recirculation pump are mounted to said casing such the said drain pump and said recirculation pump are substantially side by side.

11. The pump assembly of claim 9, wherein said the labyrinth filter portion of said filter is positioned adjacent the inlet of said casing and the mesh filter portion of said filter is positioned adjacent the opening of said casing.

12. The pump assembly of claim 9, wherein said filter is slidingly received within the chamber of said casing such that said filter may be selectively removed from the chamber through the opening of said casing.

13. The pump assembly of claim 9, wherein the labyrinth filter portion of said filter includes a plurality of projections that extend from said filter into the chamber of said casing such that the plurality of projections cause a flow of fluid through the chamber to change direction.

14. The pump assembly of claim 9, wherein the mesh filter portion of said filter includes a plurality of holes defined by said filter, the plurality of holes permitting a flow of fluid through the chamber to enter the recirculation pump from the chamber of said casing.

15. The pump assembly of claim 9, wherein said filter includes a partition disposed between the labyrinth filter portion of said filter and the mesh filter portion of said filter, the partition permitting a flow of fluid between the labyrinth filter portion and the mesh filter portion.

16. The pump assembly of claim 9, wherein said filter includes a plug disposed adjacent the opening of said cavity, the plug being complementary in shape to the opening of said casing, the plug including a seal disposed on a circumferential surface of said plug.

* * * * *